US006910642B2

(12) United States Patent
Maier

(10) Patent No.: US 6,910,642 B2
(45) Date of Patent: Jun. 28, 2005

(54) FUEL INJECTION VALVE

(75) Inventor: Dieter Maier, Isle of Palms, SC (US)

(73) Assignee: Robert Bosch GmbH, Stuttgart (DE)

( * ) Notice: Subject to any disclaimer, the term of this patent is extended or adjusted under 35 U.S.C. 154(b) by 132 days.

(21) Appl. No.: 10/258,298

(22) PCT Filed: Feb. 22, 2002

(86) PCT No.: PCT/DE02/00644

§ 371 (c)(1),
(2), (4) Date: Mar. 14, 2003

(87) PCT Pub. No.: WO02/066818

PCT Pub. Date: Aug. 29, 2002

(65) Prior Publication Data

US 2003/0168532 A1 Sep. 11, 2003

(30) Foreign Application Priority Data

Feb. 22, 2001 (DE) ..... 101 08 464

(51) Int. Cl.[7] ..... B05B 1/30; F02M 59/00; F02M 39/00

(52) U.S. Cl. ..... 239/585.1; 239/585.3; 239/585.5; 239/533.2; 239/533.3

(58) Field of Search ..... 239/585.1–585.5, 239/533.2, 533.3, 533.9, 88–93, 600; 251/129.15, 129.21, 127

(56) References Cited

U.S. PATENT DOCUMENTS 5,428,883 A * 7/1995 Stieglitz ..... 29/602.1
6,105,884 A 8/2000 Molnar et al.
6,131,829 A * 10/2000 Ricco ..... 239/585.1
6,186,421 B1 2/2001 Schneider et al.

FOREIGN PATENT DOCUMENTS

DE 198 53 102 12/1999
EP 1 052 398 11/2000

* cited by examiner

*Primary Examiner*—Davis Hwu
(74) *Attorney, Agent, or Firm*—Kenyon & Kenyon

(57) ABSTRACT

A fuel injector comprises a magnet coil which coacts with an armature that is impinged upon by a return spring and is configured together with a valve needle, a valve closure member that, with a valve seat element, forms a sealing seat being configured on the valve needle; and comprises at least one contact lug that is conductively connected to the magnet coil. A metal hollow body forms an inlet-side extension of the fuel injector, a connector plug having a contact lug being attachable onto the metal hollow body in such a way that the contact lug of the connector plug can be brought into conductive connection with the contact lug (6) of the magnet coil.

12 Claims, 2 Drawing Sheets

FUEL INJECTION VALVE

FIELD OF THE INVENTION

The present invention relates to a fuel injector.

BACKGROUND INFORMATION

German Published Patent Application No. 198 53 102 discloses a fuel injector for internal combustion engines that is put together from two preassembled independent assemblages. A functional part substantially encompasses an electromagnetic circuit and a sealing valve, while a connector part is constituted principally by a hydraulic connector and an electrical connector. In the completely assembled fuel injector, electrical connecting elements and hydraulic connecting elements of the two assemblages coact to ensure a reliable electrical and hydraulic connection. Mechanical joining of the two assemblages and good stability of the fuel injector, as well as sufficient sealing, are ensured by an injection-molded sheath around the join region.

The fuel injector known from German Published Patent Application No. 198 53 102 is disadvantageous in particular because the electrical plug contact produced integrally with the injection-molded sheath can be adapted only with great complexity (by retooling the injection-molding machines) to different plug connector systems.

In addition, the fact that fuel passes through the injection-molded plastic connector part is disadvantageous because the plastic is exposed to the dissolving ability of the fuel, and leaks can thereby occur due to dissolution of the plastic. The stability of the connector during operation of the internal combustion engine is also not sufficiently ensured, due to heating and subsequent deformation.

SUMMARY OF THE INVENTION

The fuel injector according to the present invention has, in contrast, the advantage that the metal hollow body which is inserted into an inflow end of the valve sleeve of the fuel injector not only stabilizes the fuel injector but also provides a generic base for the installation of different connector plugs that can easily be clipped onto the extension of the fuel injector.

It is also advantageous that the connector plug can be slid or clipped onto the metal hollow body by a retainer, the retainer e.g. being capable of being embodied as a spring ring that partially surrounds the metal hollow body.

Advantageously, the contact lugs of the magnet coil and of the connector plug are oriented parallel to one another and to the valve sleeve, which makes possible simple installation and subsequent connection.

It is additionally advantageous that both the fuel injector and the metal hollow body can be manufactured separately and can then be combined, with no need to modify the design of the conventional components of the fuel injectors.

DETAILED DESCRIPTION

Figure 1:
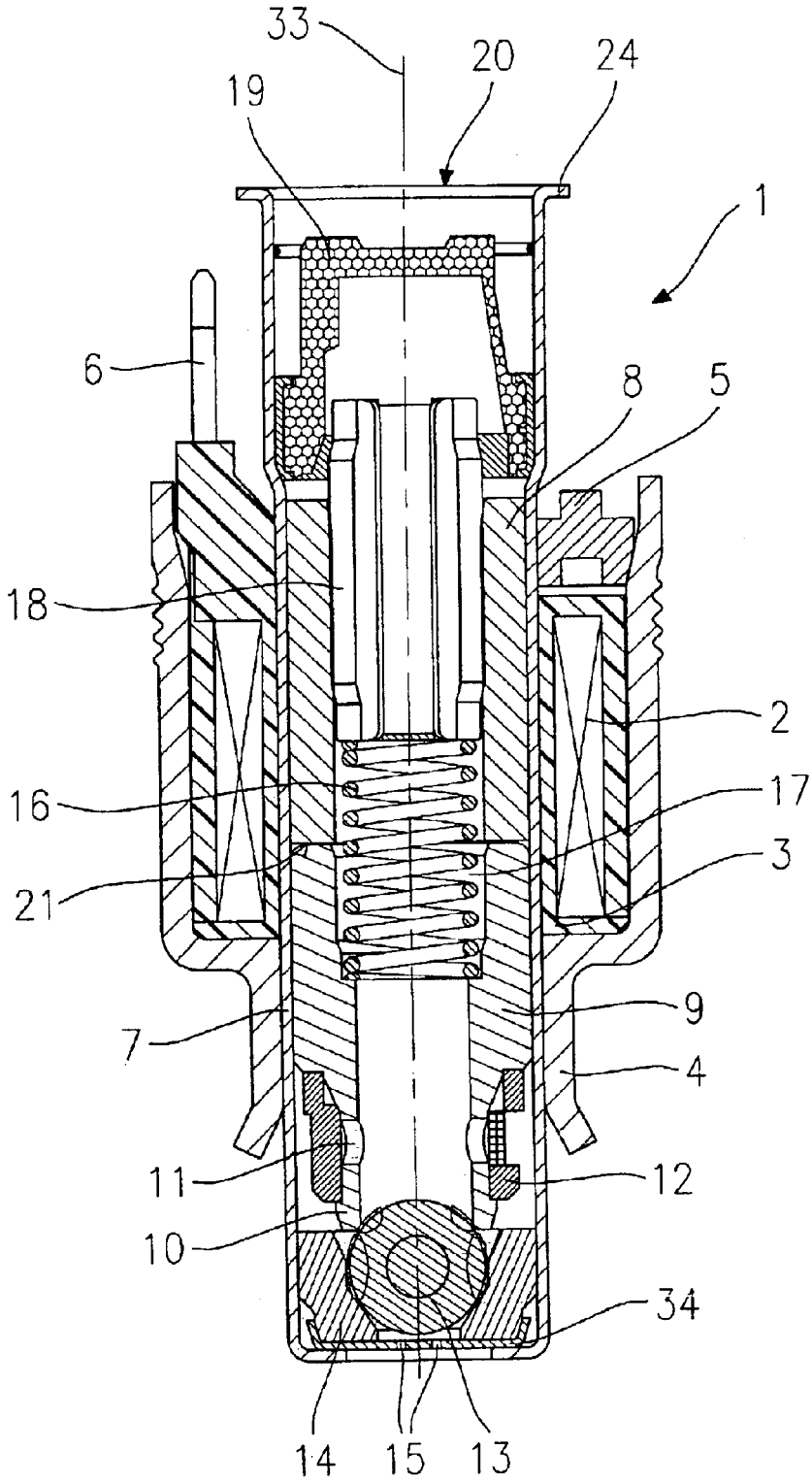
FIG. 1 is a schematic section through an exemplified embodiment of a functional part of a fuel injector.

FIG. 1 shows, in a partial and schematic sectioned depiction, a longitudinal section through a fuel injector 1 that is suitable in particular for injecting fuel into an intake manifold (not depicted in further detail) of an internal combustion engine.

Fuel injector 1 encompasses a magnet coil 2 that is wound onto a coil support 3. Coil support 3 is encapsulated in a valve housing 4 and sealed by a cover 5. Configured on coil support 3 is a contact lug 6 that, in the exemplified embodiment, is oriented parallel to a longitudinal axis 33 of fuel injector 1.

Passing through coil support 3 is a valve sleeve 7 that is of tubular configuration and encompasses a support tube 8, injection-embedded or welded therein, that serves as the internal pole of magnet coil 2. Valve housing 4, for example, can serve as the external pole of magnet coil 2. Positioned on the outflow side of support tube 8 is an armature 9 which is configured integrally with a valve needle 10. Flowthrough openings 11, which direct the fuel flowing through fuel injector 1 to a sealing seat, are provided in valve needle 10.

An annular filter 12 for filtering the fuel is positioned in the region of flowthrough openings 11. Valve needle 10 is in working engagement, preferably by welding, with a valve closure member 13 (spherical in the exemplified embodiment) that, with a valve seat element 14, forms a sealing seat. Configured downstream from the sealing seat in a perforated spray disk 34 is at least one spray discharge opening 15 from which fuel is injected into the intake manifold (not depicted further).

When fuel injector 1 is in the inactive state, armature 9 is impinged upon by a return spring 16 in such a way that fuel injector 1 is held closed by the pressure of valve closure member 13 on valve seat element 14. Return spring 16 is positioned in a recess 17 of armature 9 and of support tube 8, and is preloaded by an adjusting sleeve 18. On the inflow side of adjusting sleeve 18, a cup-shaped filter element 19 is preferably pressed into valve sleeve 7. The fuel that is introduced through a central fuel inlet 20 flows through fuel injector 1 through recess 17 and flowthrough openings 11 to the sealing seat and to spray discharge opening 15.

When an electric current is conveyed to magnet coil 2 via an electrical line (not depicted in further detail) and contact lug 6, a magnetic field is established that, when sufficiently strong, pulls armature 9 against the force of return spring 16 into magnet coil 2, opposite to the flow direction of the fuel. A working gap 21 configured between armature 9 and support tube 8 is thereby closed. As a result of the motion of armature 9, valve needle 10 configured integrally with armature is also carried along in the linear stroke direction, so that valve closure member 13 lifts off from valve seat element 14 and fuel is directed to spray discharge opening 15.

Fuel injector 1 is closed as soon as the current energizing magnet coil 2 is shut off and the magnetic field has decayed sufficiently that return spring 16 pushes armature 9 away from support tube 8, so that valve needle 10 moves in the outflow direction and valve closure member 13 settles onto valve scat element 14.

Figure 2:
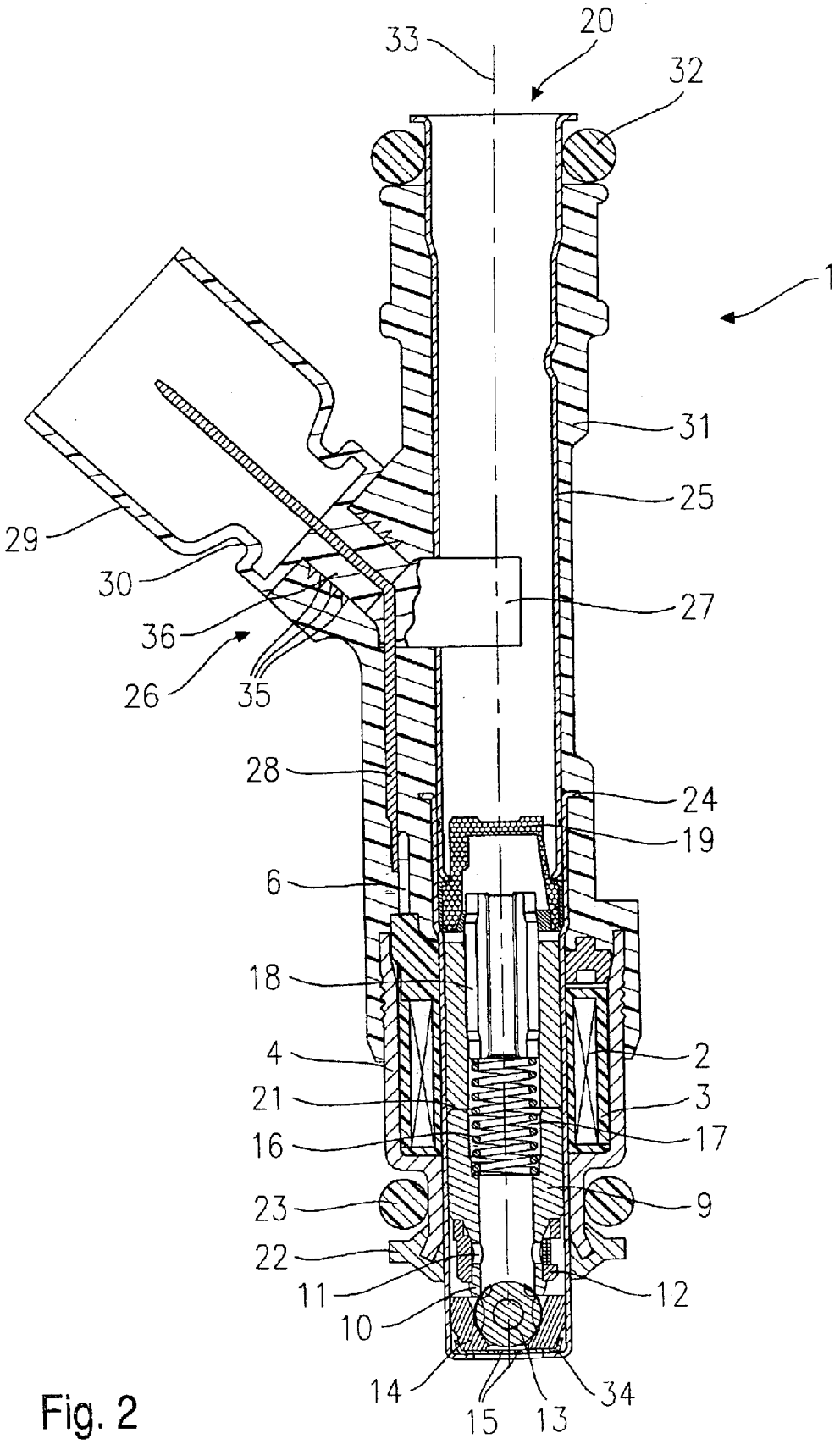
FIG. 2 is a schematic section through the fuel injector depicted in FIG. 1, combined with the connector part configured according to the present invention.

FIG. 2 shows, in a partial sectioned depiction, fuel injector 1 that is depicted in FIG. 1 and is assembled and equipped with the features according to the present invention. Identical components arc labeled with matching reference characters. Repetition of the description of previously known components can be dispensed with.

Fuel injector 1 is depicted in FIG. 2 in a completely manufactured state. A collar 22 is placed or injection-molded onto valve housing 4 at its lower end, thereby forming an annular groove into which a first seal 23 is introduced.

An annular metal hollow body 25 is inserted into an inflow end 24 of valve sleeve 7 and is welded to valve sleeve 7 e.g. in the region of filter clement 19. A customer-specific retainer 26 is slipped onto metal hollow body 25 by a retainer 27, preferably made of plastic, which is embodied e.g. as a spring ring and at least partially surrounds metal hollow body 25. Connector plug 26 has a contact lug 28 that is directed toward contact lug 6 of magnet coil 2 and is joined thereto after assembly by suitable techniques such as e.g. welding, soldering, or adhesive bonding, or by way of a crimped or plug connection.

In order to protect contact lug 28 during further processing of fuel injector 1, connector plug 26 has a plastic sleeve 29 that surrounds contact lug 28 and projects beyond it. Plastic sleeve 29 is also referred to as a "clip connector," and possesses a circumferential groove 30 that, during further processing, serves as a mount for an injection-embedding mold.

After the assembly of connector plug 26, fuel injector 1 and metal hollow body 25 joined thereto are equipped with an injection-molded plastic sheath 31 and equipped, for mounting on a fuel distribution line, with a second seal 32. For that purpose, the respective customer-specific electrical connector plugs 26 are, for example, introduced into a customer's own injection-embedding molds.

Sealing between connector plug 26 and injection-molded plastic sheath 31 is accomplished by melting connector plug 26 in the region of specifically shaped, annularly circumferential ridges 35 in central region 36 of connector plug 26, for which reason the plastic of injection-molded plastic sheath 31 must have a higher melting point than that of connector plug 26.

Ideally, connector plug 26 is used in a specific desired color of plastic, so that connector plugs 26, serving for color identification, clearly characterize fuel injector 1 without additional instructions. With a color identification system of this kind, different valve types can be classified very easily.

With the features described above, it is possible to manufacture a fuel injector 1 having a generic magnet coil 2 and a generic contact lug 6 that can each be equipped with any desired electrical connector plug 26, with no need to have a test stand and fabrication device available at the factory for each of the different connector plugs 26.

The invention is not limited to the exemplified embodiment presented and is also applicable e.g. to fuel injectors 1 of any design.

What is claimed is:

1. A fuel injector, comprising:

a return spring;

a valve needle;

an armature that is impinged upon by the return spring and that forms with the valve needle an axially movable part;

a magnet coil that coacts with the armature;

a valve seat element;

a valve closure member provided on the valve needle and forming, together with the valve seat element, a sealing seat;

at least one first contact lug that is conductively connected to the magnet coil;

a valve sleeve;

a metal hollow body forming an inlet-side extension of the fuel injector and being inserted into the valve sleeve;

a retainer; and a connector plug including at least one second contact lug on the retainer, the connector plug being clamped onto the metal hollow body such that each of the at least one second contact lug of the connector plug is conductively connected to the at least one first contact lug of the magnet coil.

2. The fuel injector as recited in claim 1, wherein:

the at least one first contact lug of the magnet coil is oriented parallel to the valve sleeve.

3. The fuel injector as recited in claim 1, wherein:

the retainer of the connector plug at least partially surrounds the metal hollow body.

4. The fuel injector as recited in claim 1, wherein:

the at least one second contact lug of the connector plug is oriented parallel to the at least one first contact lug of the magnet coil.

5. The fuel injector as recited in claim 1, wherein the connector plug is clamped onto the metal hollow body by the retainer.

6. The fuel injector as recited in claim 1, wherein the retainer is positioned at the connector plug.

7. The fuel injector as recited in claim 1, wherein the retainer is a spring ring.

8. The fuel injector as recited in claim 7, wherein the spring ring at least partially surrounds the metal hollow body.

9. A fuel injector, comprising:

a return spring;

valve needle;

an armature that is impinged upon by the return spring and that forms with the valve needle an axially movable part;

a magnet coil that coacts with the armature;

a valve seat element;

a valve closure member provided on the valve needle and forming, together with the valve seat element, a sealing seat;

at least one first contact lug that is conductively connected to the magnet coil;

a valve sleeve;

a metal hollow body forming an inlet-side extension of the fuel injector and being inserted into the valve sleeve;

a retainer; and a connector plug including at least one second contact lug on the retainer, the connector plug being clamped onto the metal hollow body such that each of the at least one second contact lug of the connector plug is conductively connected to the at least one first contact lug of the magnet coil, wherein:

after an installation and connection of the at least one first contact lug and the at least one second contact lug, the connector plug is immobilized on the metal hollow body by an injection-molded plastic sheath.

10. The fuel injector as recited in claim 9, wherein:

the connector plug includes, outside the retainer, a region on which at least one annularly elevated circumferential ridge is provided.

11. The fuel injector as recited in claim 10, wherein:

a plastic of the injection-molded plastic sheath has a higher melting point than a plastic of the connector plug, so that when the connector plug is injection-molded on, the at least one annularly elevated circumferential ridge is melted and a sealed joining is thereby achieved.

12. A fuel injector comprising:

a return spring;

a valve needle;

an armature that is impinged upon by the return spring and that forms with the valve needle an axially movable part;

a magnet coil that coacts with the armature;

a valve seat element;

a valve closure member provided on the valve needle and forming, together with the valve seat element, a sealing seat;

at least one first contact lug that is conductively connected to the magnet coil;

a valve sleeve;

a metal hollow body forming an inlet-side extension of the fuel injector and being inserted into the valve sleeve;

a retainer;

a connector plug including at least one second contact lug on the retainer, the connector plug being clamped onto the metal hollow body such that each of the at least one second contact lug of the connector plug is conductively connected to the at least one first contact lug of the magnet coil; and a plastic sleeve provided on the connector plug and including a groove on which an injection-embedding mold can be mounted.

* * * * *